US008974236B2

(12) United States Patent
Terhune, IV

(10) Patent No.: US 8,974,236 B2
(45) Date of Patent: Mar. 10, 2015

(54) LOW PROFILE ELECTRICAL CONNECTOR

(75) Inventor: Albert Harvey Terhune, IV, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 260 days.

(21) Appl. No.: 13/558,342

(22) Filed: Jul. 26, 2012

(65) Prior Publication Data

US 2014/0030925 A1 Jan. 30, 2014

(51) Int. Cl.
*H01R 12/00* (2006.01)

(52) U.S. Cl.
USPC ..... 439/78; 439/733.1

(58) Field of Classification Search
USPC ..... 439/733.1, 851, 856, 66, 70, 857
See application file for complete search history.

(56) References Cited

U.S. PATENT DOCUMENTS 4,161,346 A * 7/1979 Cherian et al. ..... 439/66
4,655,519 A * 4/1987 Evans et al. ..... 439/74
4,969,844 A * 11/1990 Sako et al. ..... 439/733.1
5,137,456 A * 8/1992 Desai et al. ..... 439/66
5,228,861 A * 7/1993 Grabbe ..... 439/66
6,257,899 B1 * 7/2001 Walkup ..... 439/66
6,375,474 B1 * 4/2002 Harper et al. ..... 439/66
6,561,831 B1 * 5/2003 McHugh et al. ..... 439/342
6,877,998 B1 * 4/2005 Kim et al. ..... 439/108
6,994,565 B2 * 2/2006 Harper, Jr. ..... 439/66
7,074,048 B2 7/2006 Liao et al.
7,857,633 B2 * 12/2010 Hashimoto et al. ..... 439/66
7,887,336 B2 * 2/2011 Nikaido et al. ..... 439/66
7,900,347 B2 * 3/2011 Rathburn ..... 29/831
8,172,581 B2 * 5/2012 Yeh ..... 439/70
2005/0059276 A1 * 3/2005 Lee et al. ..... 439/83
2006/0178031 A1 * 8/2006 Lai ..... 439/331
2008/0009151 A1 * 1/2008 Fan ..... 439/71
2008/0171478 A1 * 7/2008 Tsai ..... 439/862
2011/0076862 A1 * 3/2011 Yeh ..... 439/70

* cited by examiner

*Primary Examiner* — Briggitte R Hammond
(74) *Attorney, Agent, or Firm* — Wei Te Chung; Ming Chieh Chang

(57) ABSTRACT

An electrical connector for electrically connecting a central processing unit (CPU) to a printed circuit board (PCB) includes a housing, a number of contacts, and a number of solder balls. The housing has a number of passageways extending passing through the housing and a number of protrusions located outside the passageways and corresponding the passageways one-to-one. A number of contacts partially are disposed in the passageways and each has a hole to match with the protrusion and secure the contacts on the housing. A number of solder balls are connected with corresponding contacts.

20 Claims, 5 Drawing Sheets

LOW PROFILE ELECTRICAL CONNECTOR

BACKGROUND OF THE INVENTION

1. Field of the invention

The present invention relates to an electrical connector for electrically connecting a Central Processing Unit (CPU) to a printed circuit board (PCB), especially to a low profile electrical connector.

2. Description of Related Art

Central Processing Unit (CPU) electrical connectors are widely used for establishing electrical connection between the CPU and a printed circuit board (PCB). Therefore, CPU connectors are mounted on motherboards and hold CPUs execution of programs. Sever types of CPU connectors are available with different structures. For example, a type of land grid array (LGA) socket is found in U.S. Pat. No. 7,074,048 issued to Liao et al. (hereinafter "Liao") on Jul. 11, 2006. Liao discloses a LGA socket including an insulative housing having a plurality of passageways passing through a top surface to a bottom surface of the insulative housing. Each passageway accommodates a terminal which includes a base portion positioned in a vertical direction, an elastic arm extending upwardly from the base portion and a solder portion bent horizontally from a bottom of the base portion. The base portion has a plurality of barbs on two opposite sides thereof for engaging with sidewalls of the passageway to secure the contact in the passageway. A solder ball is soldered on a bottom surface of the solder portion for electrically connecting with the PCB.

The contact is received in the passageway by the barbs which causes the height of the contact must be increased so as to unfavorable to low profile of the electrical connector.

Hence, it is desirable to provide an improved electrical connector to overcome the aforementioned disadvantages.

SUMMARY OF THE INVENTION

Accordingly, an object of the present invention is to provide a lower profile electrical connector with a low contact.

According to one aspect of the present invention, there is provided an electrical connector for electrically connecting a central processing unit (CPU) to a printed circuit board (PCB), comprising a housing, a plurality of contacts, and a plurality of solder balls. The housing has a plurality of passageways extending passing through the housing and a plurality of protrusions located outside the passageways and corresponding the passageways one-to-one. A plurality of contacts partially are disposed in the passageways and each has a hole to match with the protrusion and secure the contacts on the housing. A plurality of solder balls are connected with corresponding contacts.

According to another aspect of the present invention, there is provided an electrical connector, comprising a housing with a plurality of passageways. A plurality of contacts are partially received in corresponding passageways. Each contact has a base portion fixed on the housing and not positioned in the passageway. A plurality of solder balls are connected with corresponding contacts and located just below the base portion.

Other objects, advantages and novel features of the invention will become more apparent from the following detailed description of a preferred embodiment when taken in conjunction with the accompanying drawings.

DETAILED DESCRIPTION OF THE INVENTION

Reference will now be made to the drawings to describe the present invention in detail.

Figure 1:
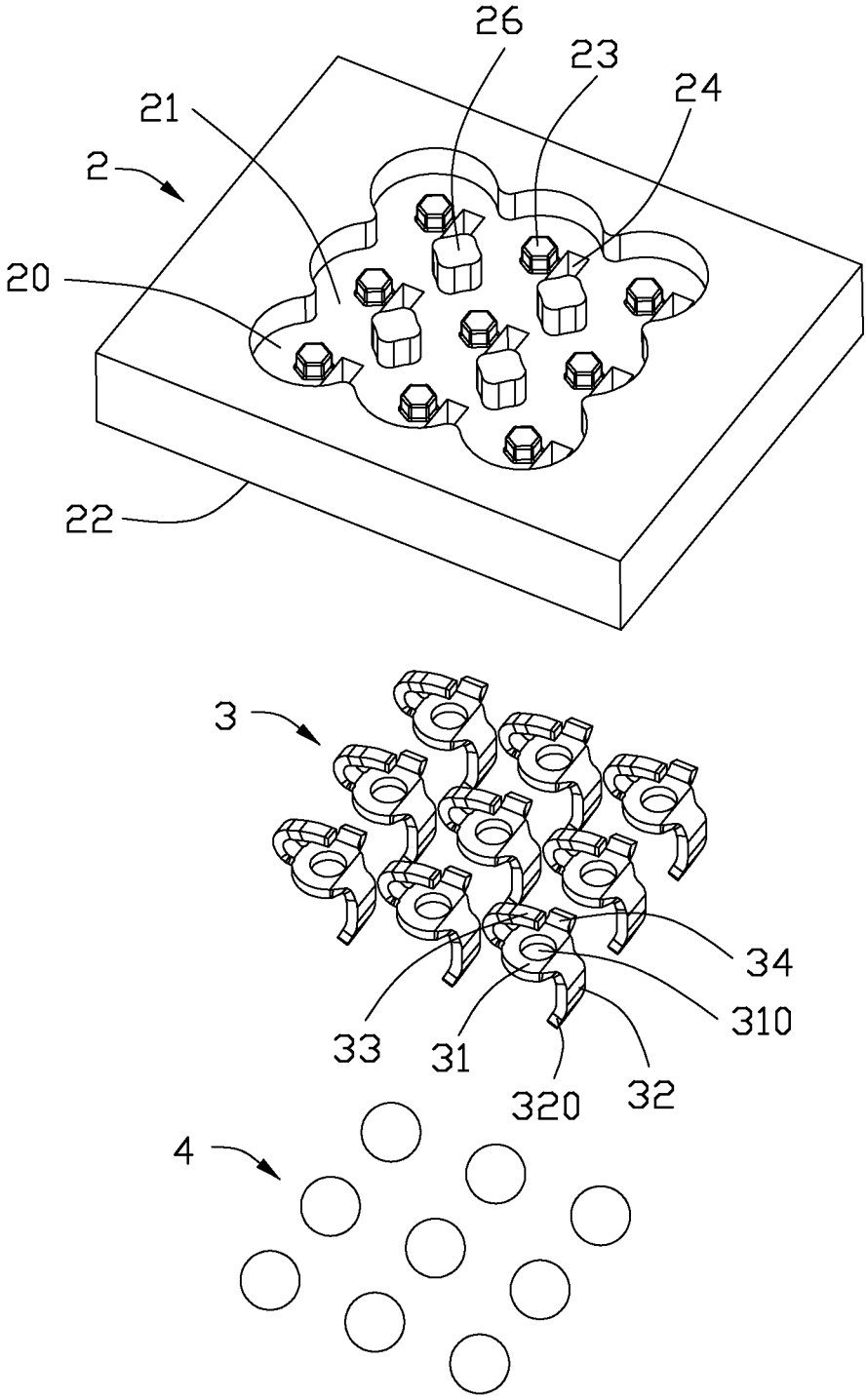
FIG. 1 is an exploded, perspective view of an electrical connector in accordance with the present invention.
Figure 2:
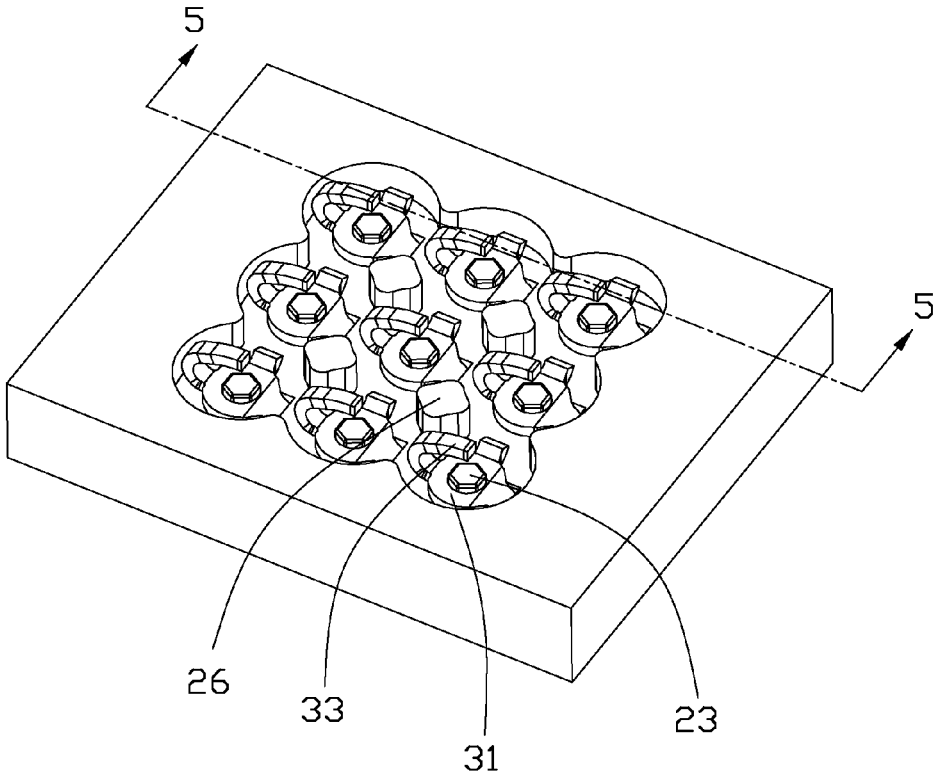
FIG. 2 is an assembled, perspective view of the electrical connector shown in FIG. 1.
Figure 3:
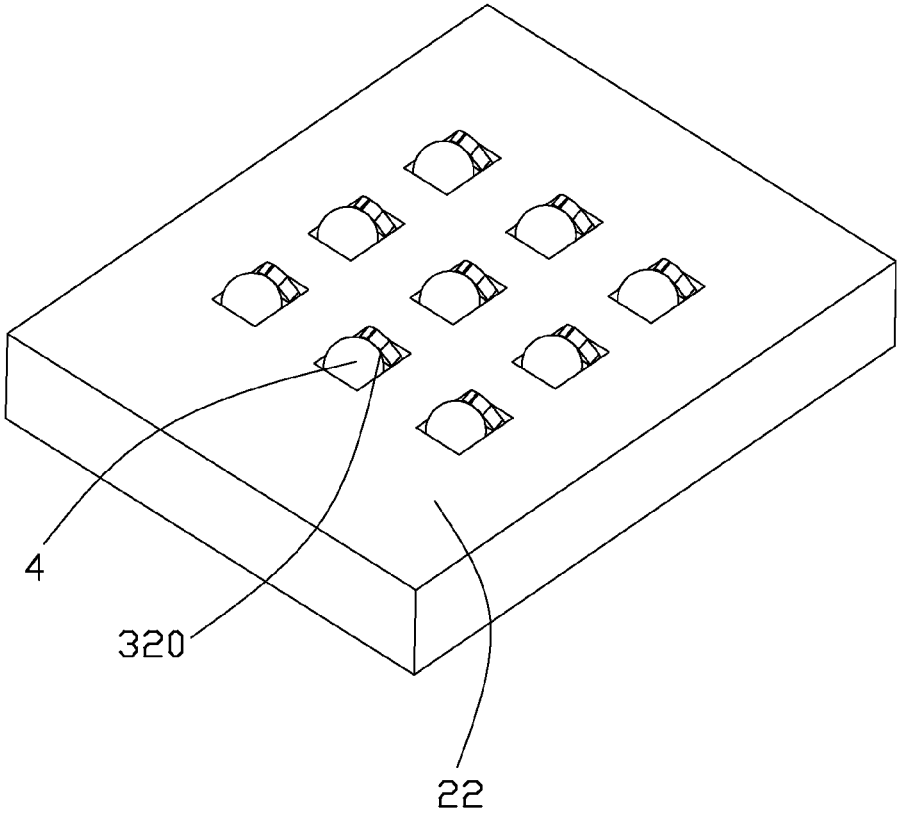
FIG. 3 is a perspective view of FIG. 2 taken from below.
Figure 4:
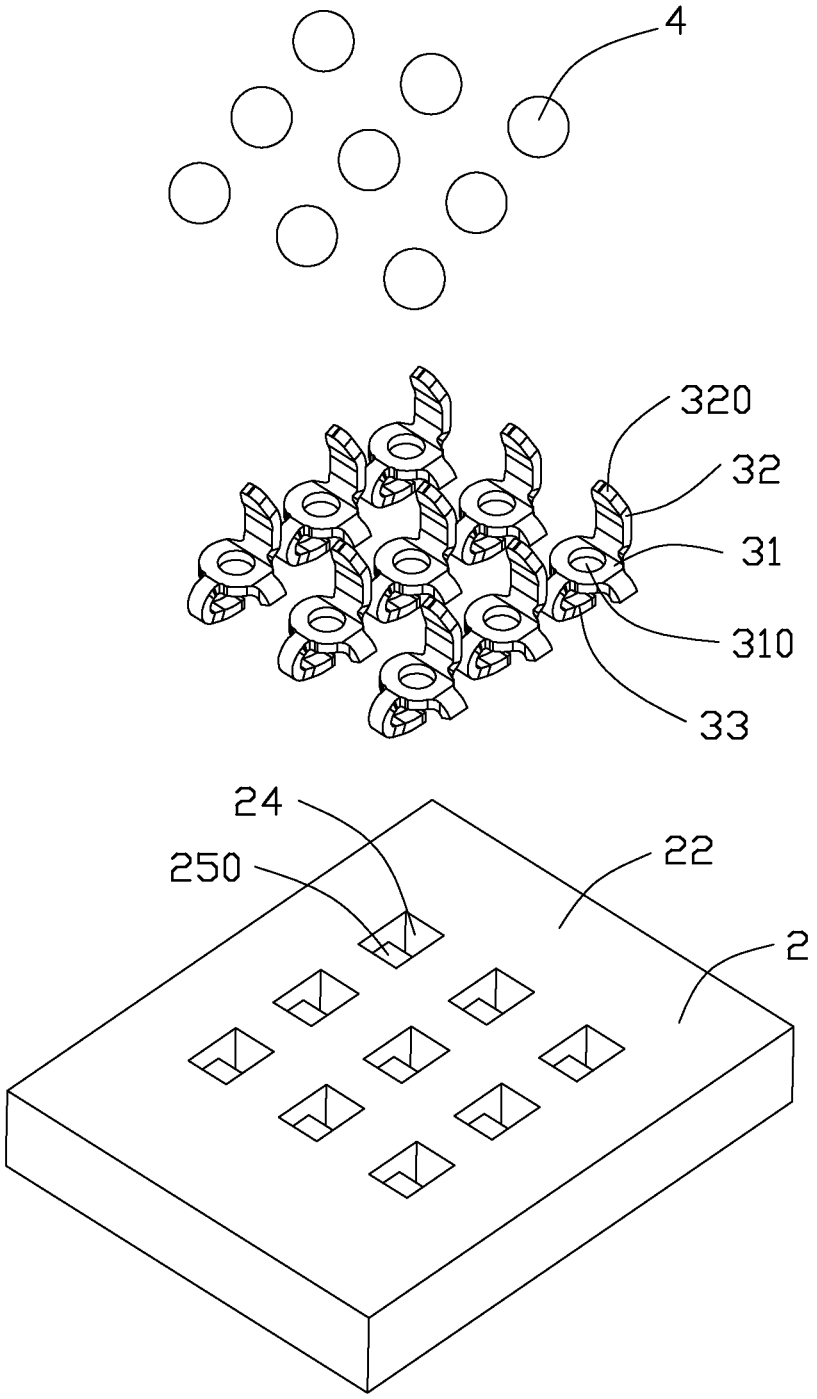
FIG. 4 is a perspective view of FIG. 1 taken from below.

FIGS. 1-3 illustrate an electrical connector of the present invention for electrically connecting a CPU (central processing unit) to a PCB (printed circuit board). The electrical connector comprises an insulative housing 2, a plurality of contacts 3 received in the housing 2 and a plurality of solder balls 4 clamped by the contact 3 and the housing 2.

Figure 5:
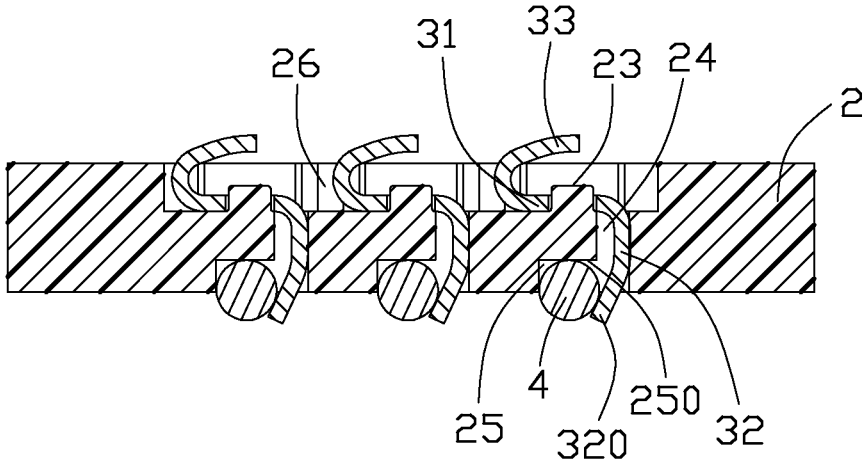
FIG. 5 is a cross-sectional view taken along line 5-5 of FIG. 2.

Referring to FIGS. 1 and 5, each contact 3 includes a horizontally base portion 31 with a hole 310. The base portion 31 having a substantially circle shape is concentric with the hole 310. A spring portion 33 extends upwardly and inwardly from the base portion 31 and is substantially positioned upon the base portion 31 seeing from a side view. A tail portion 32 extends downwardly from the base portion 31 and is substantially positioned at a side of the base portion 31 seeing from a side view. The tail portion 32 has an incline portion 320 extending inwardly from the tail portion 32. The spring portion 33 and the tail portion 32 are located at two side of the base portion 31, and while located at a centre line of the base portion 31. A carrier strip linking section 34 is supported at the base portion 31 and extends upwardly for assembling the contact 3 to the housing 2.

Referring to FIGS. 1,3,4 and 5, the housing 2 has a cavity 20 having a receiving/supporting surface 21. The receiving surface 21 of the cavity 20 has a plurality of protrusions 23 extending upwardly therefrom and a plurality of passageways 24 passing through the receiving surface 21 and a bottom surface 22 of housing 2. The protrusion 23 is use for alignment and retention the contact 3. Each passageway 24 is located at a side of the corresponding protrusion 23 to allow the tail portion 32 passing through thereof. A plurality of receiving recesses 25 are defined at the bottom surface 22 of the housing 2 and communicate with corresponding passageways 24 for receiving the solder balls 4. Each recess 25 defines a resisting surface 250 substantially just below the protrusion 23 to resist the solder ball 4 moving upwardly in a vertical direction, furthermore, the inclined portion 320 and edge of the recess 25 to clamp the solder ball 4 so as to prevent the solder ball 4 to fall of the recess 25. The receiving surface 21 of cavity 20 further has a plurality of posts 26 extending upwardly and higher than the protrusions 23 for supporting the CPU. The posts 26 flush with a top surface of the housing 2.

Referring to FIGS. 2 and 5, the hole 310 of the base portion 31 is aligned and interference with the protrusion 23 so as to secure the contact 3 on the housing 2, and under that condition, the base portion 31 is seated on the receiving surface 21 of cavity 20 while the base portion 31 is substantially located just above the solder ball 4 taken from the side view so as to achieve a low profile contact 3. The spring portion 33 extends beyond the top surface of the housing 2 so as to electrically connect with the CPU. The protrusion 23 is lower than the spring portion 33 and has some distance with the spring portion 33 in a vertical direction. The protrusion 23 in this embodiment has a hexagon shape and the hole 310 in this embodiment has a circle shape, but understandably, the protrusion 23 also could be a circular shape, rectangular shape, a triangular shape, or other shape, as well as the hole 310 also could be changed to rectangular shape or other shape if so needed. Understandably, the hole 310 of the base portion 31 and the protrusion 23 on the receiving surface 21 are deemed as mutually interengaging structures to secure the contact 3 on the housing 2.

In the present invention, the cavity 20 is defined for reducing the height of the connector and the contact. Clearly, the cavity 20 also could be eliminated such that the protrusions 23 and the posts 26 are disposed on the top surface of the housing 2.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for electrically connecting a central processing unit (CPU) to a printed circuit board (PCB), comprising:

a housing defining a top surface, a bottom surface opposite to the top surface and a plurality of passageways, and the housing further defining an upward horizontal supporting surface around the top surface, the passageways penetrating the bottom surface and the supporting surface, the housing further having a plurality of protrusions extending upwardly from the supporting surface and located outside the passageways and corresponding to the passageways one-to-one;

a plurality of contacts partially disposed in the passageways and each contact having a base portion seated on the supporting surface, each base portion having a hole to receive the protrusion and secure the contacts on the housing; and a plurality of solder balls connected with corresponding contacts.

2. The electrical connector as claimed in claim 1, wherein each contact comprises a base portion with said hole, a spring portion extending upwardly from the base portion, and a tail portion extending downwardly from the base portion.

3. The electrical connector as claimed in claim 2, wherein the base portions and the spring portions extend outside the passageways, and the tail portions are received in corresponding passageways.

4. The electrical connector as claimed in claim 2, wherein the base portion is located in a horizontally direction, and the spring portion is substantially positioned just above the base portion and the tail portion is substantially positioned at a lateral side of the base portion.

5. The electrical connector as claimed in claim 2, wherein the protrusion is lower than the spring portion and has some distance with the spring portion in a vertical direction.

6. The electrical connector as claimed in claim 3, wherein the spring portion and the tail portion are located at two opposite sides of the base portion, and free ends of the spring portion and the tail portion are located at a centre line of the base portion.

7. The electrical connector as claimed in claim 2, wherein the tail portion includes an incline portion bent inwardly from the tail portion.

8. The electrical connector as claimed in claim 1, wherein the housing defines a plurality of recesses at a bottom surface of the housing and each communicates with corresponding passageway.

9. The electrical connector as claimed in claim 8, wherein the recess is substantially just below the protrusion.

10. The electrical connector as claimed in claim 8, wherein each recess defines a resisting surface to resist the solder ball moving upwardly in a vertical direction, and the tail portion and the housing together clamp the solder ball so as to prevent the solder ball from falling out of the recess.

11. The electrical connector as claimed in claim 1, wherein a plurality of posts are arranged on the housing and extend higher than the protrusions.

12. An electrical connector, comprising:

a housing defining a top surface and a bottom surface opposite to each other, a plurality of passageways and a plurality of protrusions extending in a vertical direction;

a plurality of contacts partially received in corresponding passageways and each contact having a base portion paralleled with the top surface, each of the base portions having a hole for receiving the protrusion to fix the contact on the housing; and a plurality of solder balls connected with corresponding contacts and located just below the base portion.

13. The electrical connector as claimed in claim 12, wherein the housing defines a supporting surface paralleled with the top surface, the protrusions are formed on the supporting surface, the base portion is seated on the supporting surface.

14. The electrical connector as claimed in claim 12, wherein the contact further include a spring portion extending upwardly and inwardly from the base portion and a tail portion extending downwardly from the base portion, and the base portion is disposed in a horizontal direction, and the tail portion and the spring portions are located at two opposite sides of the base portion.

15. An electrical connector for connecting to an electronic package and mounting to a printed circuit board, comprising:

an insulative housing defining opposite top and bottom surfaces with a plurality of passageways each extending therethrough in a vertical direction, each of said passageways being equipped with an upward horizontal supporting surface around the top surface, and a recess around the bottom surface;

a plurality of contacts disposed in the corresponding passageways, respectively, each of said contacts defining an upward horizontal base portion with a spring contacting section upwardly and a tail potion downwardly extending from two different peripheral positions of the base portion;

a plurality of solder balls disposed in the corresponding recesses, respectively, for mounting to the printed circuit board;

in each of the contacts, the spring contacting section extending above the top surface for connecting with the electronic package, and the tail portion extending into the recess to be associated with the corresponding solder ball; wherein the base portion is seated upon the corresponding supporting surface for positioning the contact into the corresponding passageway, and mutually interengaging structures are formed on the base portion and the supporting surface to align and retain the base portion with the supporting surface under condition that the housing and the contacts are configured to allow said contacts to be only downwardly, from the top surface to the bottom surface, assembled into the corresponding passageways, respectively.

16. The electrical connector as claimed in claim 15, wherein the tail potion includes an inclined portion, and the passageway is dimensioned with a sufficient width to allow said inclined portion to pass through when the contact is downwardly assembled into the passageway.

17. The electrical connector as claimed in claim 15, wherein said two different peripheral positions are opposite to each other.

18. The electrical connector as claimed in claim 17, wherein the base portion further defines another peripheral position essentially equidistantly located between said two opposite different peripheral positions, where a carrier strip linking section is formed.

19. The electrical connector as claimed in claim 15, wherein the mutually interengaging structures performs an interference fit therebetween.

20. The electrical connector as claimed in claim 15, wherein said mutually interengaging structures include a hole in the base portion and a protrusion on the supporting portion.

* * * * *